US007287524B2

(12) United States Patent
Hamada et al.

(10) Patent No.: US 7,287,524 B2
(45) Date of Patent: Oct. 30, 2007

(54) INTERNAL COMBUSTION ENGINE IGNITION DEVICE

(75) Inventors: Kazuya Hamada, Tokyo (JP); Takeshi Shimizu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/448,722

(22) Filed: Jun. 8, 2006

(65) Prior Publication Data

US 2007/0023019 A1 Feb. 1, 2007

(30) Foreign Application Priority Data

Jul. 27, 2005 (JP) ..... 2005-216590

(51) Int. Cl.
*H01F 38/12* (2006.01)

(52) U.S. Cl. ..... 123/634

(58) Field of Classification Search ..... 123/634–635, 123/647

See application file for complete search history.

(56) References Cited

U.S. PATENT DOCUMENTS 5,915,367 A * 6/1999 Oishi et al. ..... 123/635
6,257,215 B1 * 7/2001 Kaminaga et al. ..... 123/647
6,575,151 B2 * 6/2003 Murata et al. ..... 123/647
6,622,711 B1 * 9/2003 Skinner et al. ..... 123/634
6,655,367 B2 * 12/2003 Ohkama et al. ..... 123/634
7,107,977 B2 * 9/2006 Kojima et al. ..... 123/647
2003/0005914 A1 * 1/2003 Ohkama et al. ..... 123/634
2004/0069288 A1 * 4/2004 Shimada et al. ..... 123/635
2007/0012301 A1 * 1/2007 Tauchi et al. ..... 123/634

FOREIGN PATENT DOCUMENTS

JP 6-31134 U 4/1994

* cited by examiner

*Primary Examiner*—Hai Huynh
(74) *Attorney, Agent, or Firm*—Sughrue Mion Pllc.

(57) ABSTRACT

An internal combustion engine ignition device is provided with a connector including first external connection terminal, and second external connection terminal. The first external connection terminals is formed with no noble metal coat, while the second external connection terminal is formed with a noble metal coat. The first external connection terminal is disposed on the outer side of terminal arrangement in the connector, and the second external connection terminal is disposed on the center side of terminal arrangement in the connector.

6 Claims, 7 Drawing Sheets

INTERNAL COMBUSTION ENGINE IGNITION DEVICE

BACKGROUND OF THE INVENTION

1. Field of the Invention

The present invention relates to a connector structure of an internal combustion engine ignition device causing an ignition plug of the internal combustion engine to make a spark discharge.

2. Description of the Related Art

Conventionally, as an internal combustion engine ignition coil, there is the one that comprises a primary connector including a low voltage terminal for providing the electrical connection between a primary coil and a switching module integrally at a part of an insulating case as shown in, for example, the Japanese Laid-open Utility Model Publication No. 31134/1994 (Paragraph [0003]).

In a connector of an internal combustion engine ignition coil, there are several numbers of external connection terminals requiring no noble metal coat for a transformer, and external connection terminals requiring the noble metal coat for a control circuit section. These external connection terminals are manufactured by press working into a single piece with the use of a material 200 to be pressed as shown in FIG. 9. That is, in the material 200 to be pressed, a striped pattern of noble metal coat (hatched part 201) has preliminarily been applied to a terminal area 200*a* requiring the electrical contact function in the internal part of the connector. As a result, the same striped pattern of noble metal coat is applied to the external connection terminals requiring no noble metal coat.

In addition, unnecessary parts that are not used as a product after the press working are thrown away as scraps; and the cost of noble meta coat onto the above-mentioned scraps around the external connection terminals requiring no noble metal coat is added to material costs. As a result, higher costs of the product will be induced.

Further, since a noble metal coat is applied to all the external connection terminals in the connector, groping of external connection terminals through which a large current and a small current are carried is not always definite. Thus, there are some cases in which a group of external connection terminals through which a large current is carried are disposed adjacent to each other, and there is a problem of causing short circuit fault between the external connection terminals through which a large current is carried in the small connector.

SUMMARY OF THE INVENTION

The present invention was made to solve the problems as mentioned above, and has an object of providing a connector of an internal combustion engine ignition device in which a noble metal coat is reliably applied to external connection terminals requiring the noble metal coat, while no noble metal coat is applied to external connection terminals requiring no noble metal coat.

Another object of the invention is to provide a connector of an internal combustion engine ignition device in which no external connection terminals through which a large current is carried are located adjacent to each other.

An internal combustion engine ignition device according to the invention comprises: a transformer that generates a high voltage at a secondary coil by carrying or interrupting a primary current flowing through a primary coil; a control circuit section that controls the primary current in response to a control signal from outside; and a connector including a first external connection terminal carrying a current for the transformer, and a second external connection terminal carrying a current for the control circuit section; and in which, out of the first external connection terminal and the second external connection terminal, only the second external connection terminal is provided with a noble metal coat.

According to the internal combustion engine ignition device of the invention, the noble metal coat is reliably applied onto the second external connection terminals requiring the noble metal coat, while no noble metal coat is applied onto the first external connection terminals requiring no noble metal coat, thus enabling to achieve the lower production cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
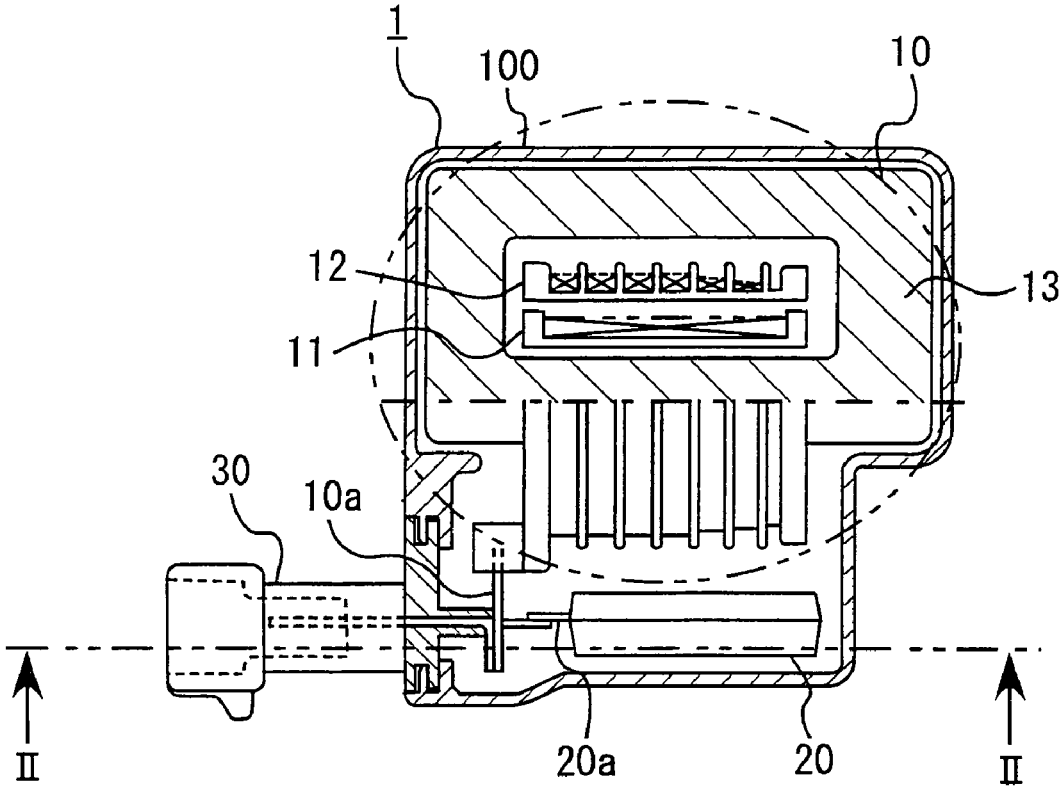
FIG. 1 is a partially cross sectional view showing the entire construction of an internal combustion engine ignition device according to a first embodiment of the present invention.

Several preferred embodiments according to the present invention are hereinafter described referring to the drawings.

Embodiment 1

Figure 2:
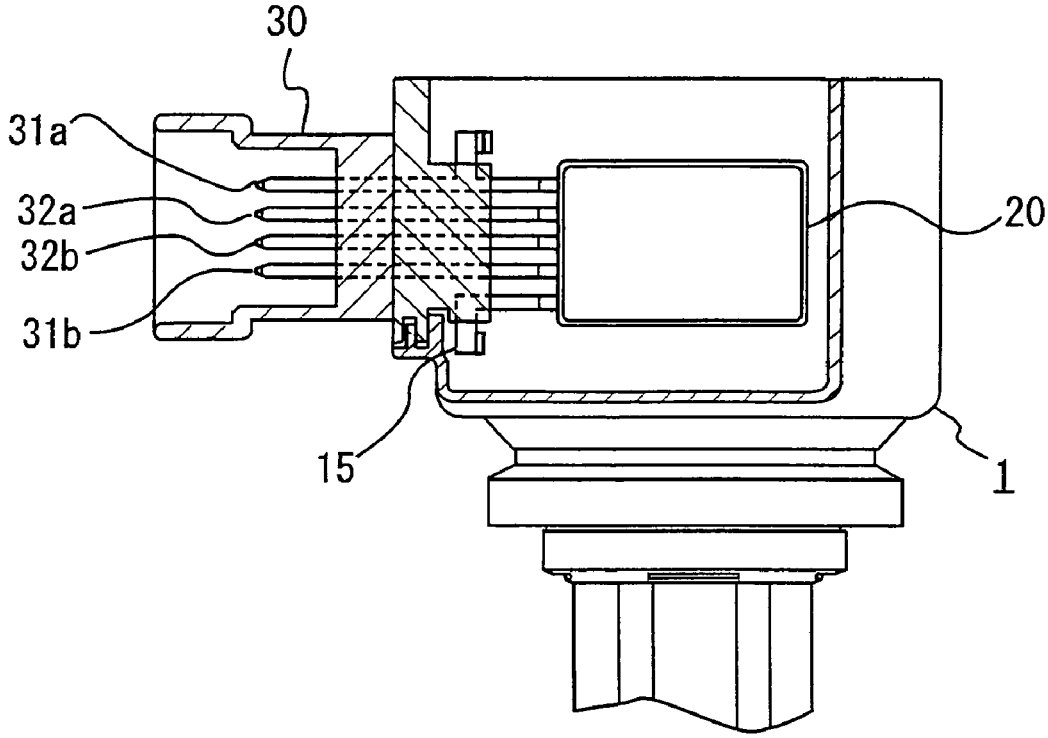
FIG. 2 is a cross sectional view taken along the line II-II of the internal combustion engine ignition device of FIG. 1.

FIG. 1 is a partially cross sectional view showing the entire construction of an internal combustion engine ignition device according to a first embodiment of the invention, and FIG. 2 is a cross sectional view taken along the line II-II of the internal combustion engine ignition device of FIG. 1.

With reference to FIGS. 1 and 2, a transformer 10 and a control circuit section 20 are contained in a case 100 of an internal combustion engine ignition device 1. Further, a connector 30 for external connection terminals is mounted onto the case 100. The transformer 10 is provided with a primary coil 11, a secondary coil 12 and an iron core 13, and acts to generate a high voltage at the secondary coil 12 by carrying and interrupting a primary current that flows through the primary coil 11. The control circuit section 20 acts to control carrying and interruption of a primary current of the above-mentioned primary coil 11.

The connector 30 includes first external connection terminals 31*a* and 31*b* for providing the electrical connection between the transformer 10 and external devices, as well as second external connection terminals 32*a* and 32*b* for providing the connection between the control circuit section 20 and external devices. A large current of ampere order is carried through the first external connection terminals 31*a* and 31*b* for the transformer; and a micro current of 1 mA level is carried through the second external connection terminals 32*a* and 32*b* for the control circuit section. In addition, reference numeral boa designates a connection terminal of the transformer 10, numeral 20*a* designates a connection terminal of the control circuit section 20, and numeral 15 designates a connection terminal providing the connection between the control circuit section 20 and the transformer 10.

Figure 3:
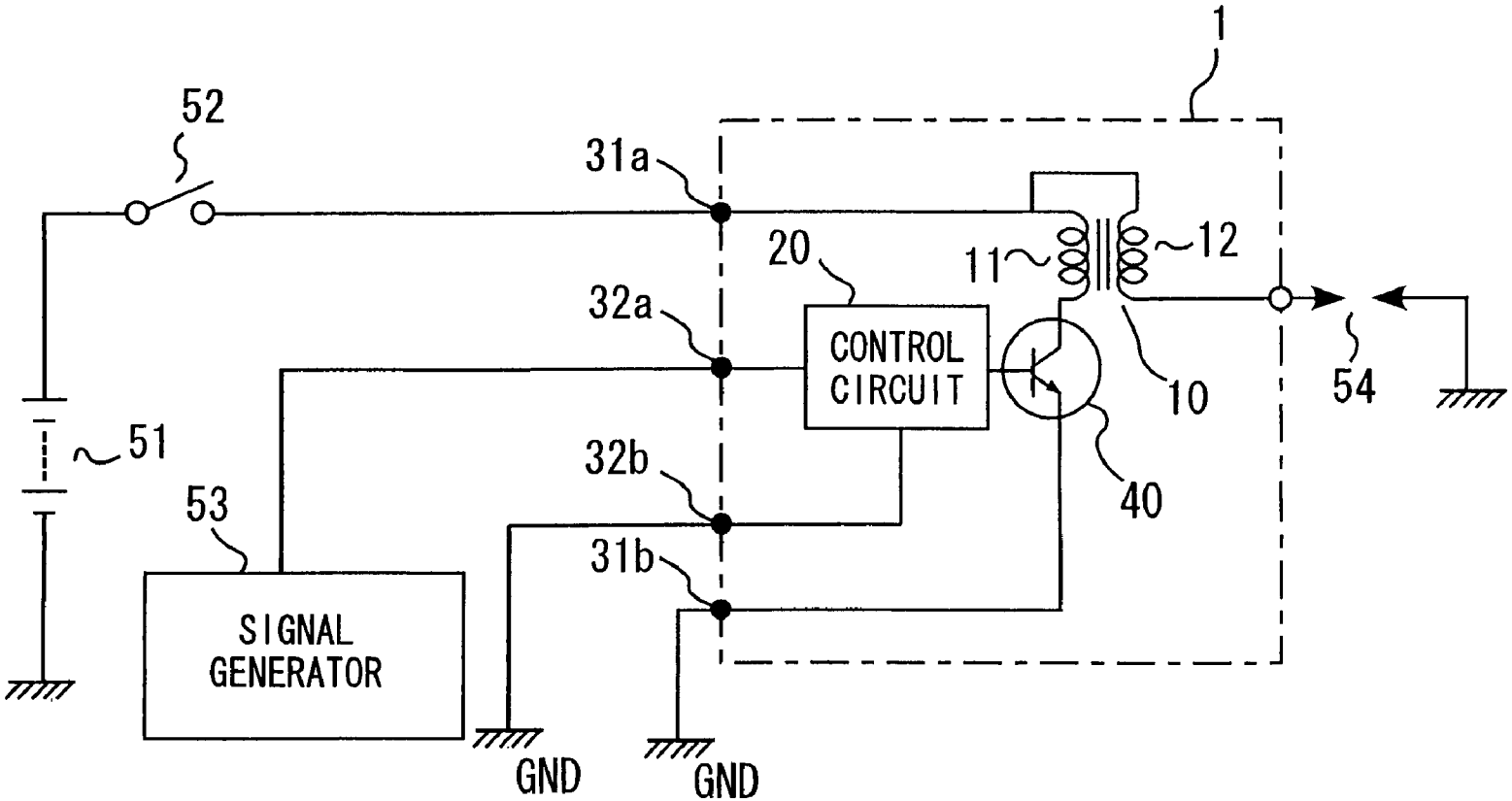
FIG. 3 is a schematic circuit diagram of the internal combustion engine ignition device of FIG. 1.

FIG. 3 is a schematic circuit diagram showing the internal combustion engine ignition device of FIG. 1. In the drawing, a battery 51 is connected to the first external connection terminal 31*a* of the internal combustion engine ignition device 1 via an ignition switch 52. The first external connection terminal 31*a* is connected to a primary coil 11 of the transformer 10 and connected to the first external connection terminal 31*b* via a transistor 40, to be grounded (GND). A control signal (ignition signal) line of a signal generator 53 is connected to the second external connection terminal 32*a*, and inputted to the control circuit section 20. The control circuit section 20 controls switching of the transistor 40. The control circuit section 20 is grounded (GND) via the second external connection terminal 32*b*. Additionally, the output from the secondary coil 12 is connected to an ignition plug 54 via a secondary connector (not shown).

Figure 4:
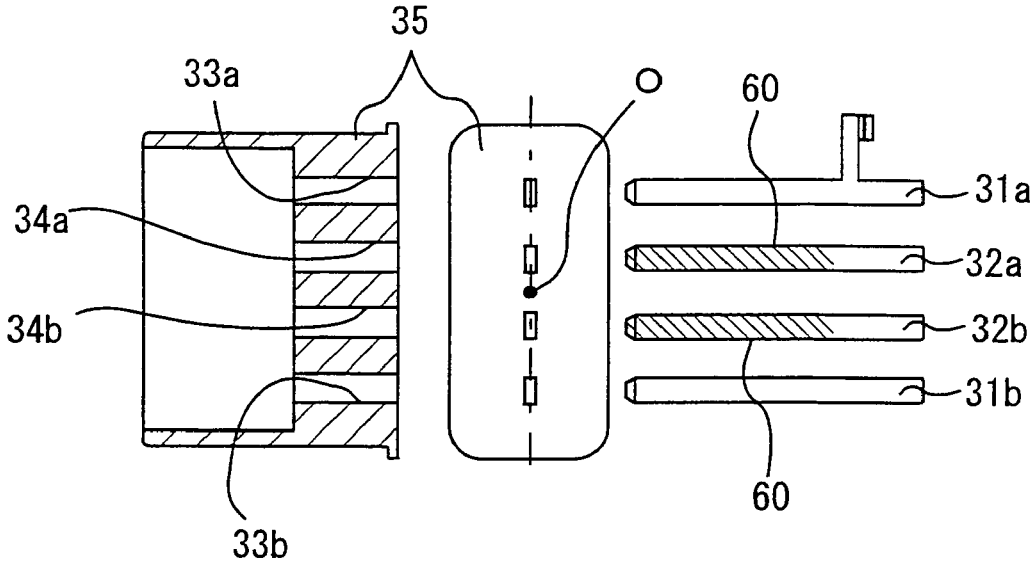
FIG. 4 is a view showing the state before external connection terminals are integrated into a connector housing of the internal combustion engine ignition device according to the first embodiment of the invention.
Figure 5:
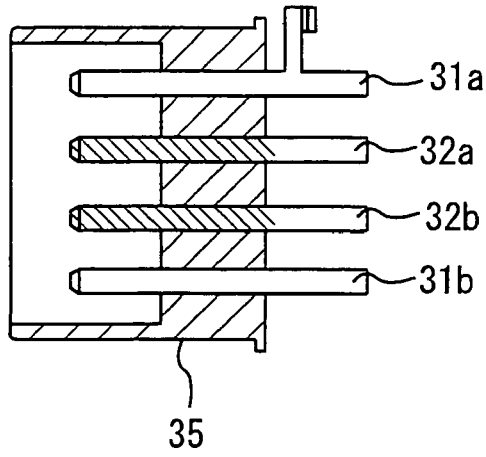
FIG. 5 is a view showing the state after the external connection terminals have been integrated into the connector housing of the internal combustion engine ignition device according to the first embodiment of the invention.

FIG. 4 is a view showing the state before the external connection terminals are integrated into a connector housing of the internal combustion engine ignition device according to the first embodiment, and FIG. 5 is a view showing the state after the external connection terminals are integrated into the connector housing of the internal combustion engine ignition device according to the first embodiment. In addition, the connection terminal 15 providing the connection between the control circuit section and the transformer 10 shown in FIG. 2 is not shown.

With reference to FIGS. 4 and 5, the first external connection terminals 31*a* and 31*b* through which a large current of ampere order is carried is provided with no noble metal coat; and the second external connection terminals 31*a* and 31*b* through which a micro current of 1 mA level is carried are provided with a noble metal coat 60 such as Au. This noble metal coat 60 acts to reduce the path loss of micro-current signals. The connector housing 35 are provided with insertion holes through which the first external connection terminals 31*a* and 31*b* are inserted; and there are provided insertion holes 34*a* and 34*b* through which the second external connection terminals 32*a* and 32*b* are inserted. Furthermore, the first external connection terminals 31*a* and 31*b* are disposed on the outer side of terminal arrangement in the connector housing 35, and the second external connection terminals 32*a* and 32*b* are located on the side of center O of terminal arrangement in the connector housing 35.

As described above, according to this first embodiment, the first external connection terminals 31*a* and 31*b* through which a large current of ampere order is carried are provided with no noble metal coat; and the second external connection terminals 32*a* and 32*b* through which a micro current of 1 mA level are provided with the noble metal coat 60. Accordingly, it is possible to save the amount of usage of a noble metal onto external connection terminals requiring no noble metal coat thereby achieving the decrease in cost.

Furthermore, the first external connection terminals 31*a* and 31*b* through which a large current of ampere order are disposed on the outer side of terminal arrangement of the connector housing 35; and the second external connection terminals 31*a* and 32*b* through which a micro current of 1 mA level is carried are located on the side of center O of terminal arrangement. Accordingly, there is an advantage of no occurrence of short circuit fault between external connection terminals through which a large current is carried.

An example of employing four numbers of external connection terminals is described in this first embodiment. However, even in the case of a connector in which the second external connection terminal provided with a noble metal coat is located in the central position of terminal arrangement, and the first external connection terminals provided with no noble metal coat are disposed on the outer side of terminal arrangement, it is possible to obtain the same advantage as in the above-described example.

In addition, the dimension of the insertion holes 33*a*, 33*b*, 34*a*, 34*b* are the same as that of the external connection terminals 31*a*, 31*b*, 32*a*, 32*b* for insertion, or is a press-fit dimension about 0.5 mm smaller than that of these external connection terminals, thereby enabling to secure the accuracy of position after the external connection terminals have been inserted.

Embodiment 2

Figure 6:
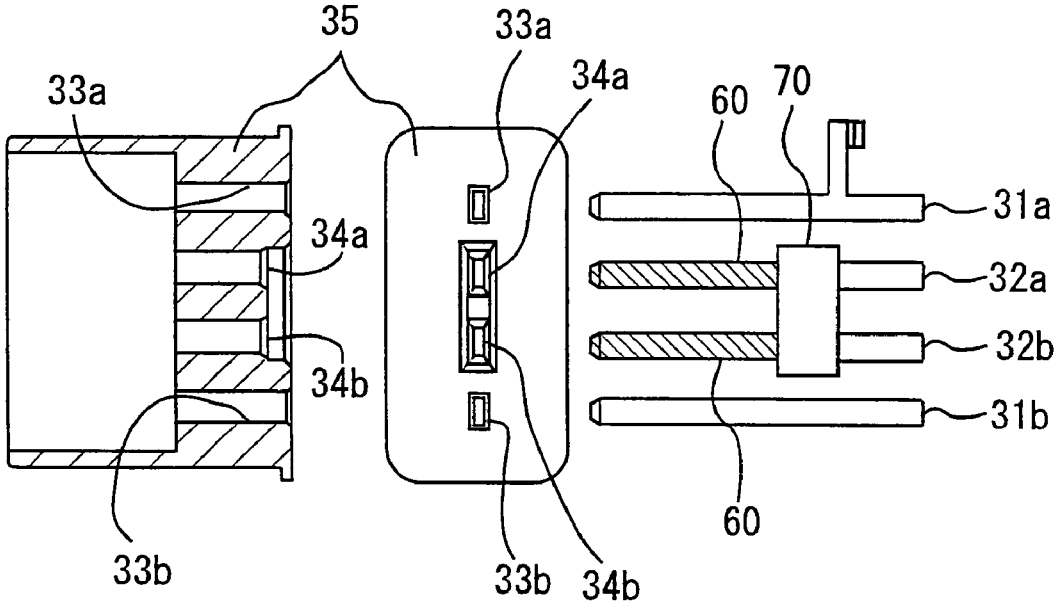
FIG. 6 is a view showing the state before external connection terminals are integrated into a connector housing of an internal combustion engine ignition device according to a second embodiment of the invention.

FIG. 6 is a view showing the state before external connection terminals are integrated into a connector housing of an internal combustion engine ignition device according to a second embodiment of the invention. Additionally, a connection terminal 15 providing the connection between the control circuit section 20 and the transformer 10 in FIG. 2 is not shown in the drawing.

According to the second embodiment, insertion holes 33*a* and 33*b* of the first external connection terminals 31*a* and 31*b*, and insertion holes 34*a* and 34*b* of the second external connection terminals 32*a* and 32*b* are differently shaped. Furthermore, the second external connection terminals 32*a* and 32*b* onto which a noble metal coat 60 is applied form an integral whole with a molded resin 70, and are arranged for insertion into the insertion holes 34*a* and 34*b* that are formed on the central side of terminal arrangement of the connector housing 35. Furthermore, concave and convex mating portions or guide formations (not shown) are provided at a part of the connector housing 35 and the integrally molded resin 70. The position of terminals in the connector housing 35 is determined with the above-mentioned concave and convex mating portions, guide formations or the like, and the other construction is in the same manner as in the foregoing embodiment.

As described above, according to the second embodiment, the insertion holes 33*a* and 33*b* of the first external connection terminals 31*a* and 31*b*, and the insertion holes 34*a* and 34*b* of the second external connection terminals 32*a* and 32*b* have different shapes, so that the first external connection terminals 31*a* and 31*b* and the second external connection terminals 32*a* and 32*b* are less like to be incorrectly integrated.

Further, the second external connection terminals 32*a* and 32*b* form an integral whole with a molded resin 70, so that there is no possibility of the second external connection terminals 32*a* and 32*b* being incorrectly integrated into the other insertion holes.

Furthermore, as to the insertion holes 34*a* and 34*b* of the second external connection terminals 32*a* and 32*b* disposed on the central side, it comes to be unnecessary to make the consideration for positioning the terminals in the connector housing 35. Therefore, to easily insert the second external connection terminals 32*a* and 32*b* in the connector housing 35, a diameter dimension of the insertion holes 34*a* and 34*b* is dimensioned to be approximately 0.1 mm to 0.3 mm larger than the outside diameter dimension of the terminals 32*a* and 32*b*. Whereas, the dimension of terminal insertion holes with respect to the dimension of the first external connection terminals 31*a* and 31*b* is set to be press-fit dimension so that the first external connection terminals 31*a* and 31*b* requiring no noble metal coat are press-fitted in the insertion holes 33*a* and 33*b* of the connector housing 35.

Moreover, the integrally molded formation of the second external connection terminals 32*a* and 32*b* onto which the noble metal coat 60 is applied is designed to be in the same configuration even when it is turned upside down.

Embodiment 3

Figure 7:
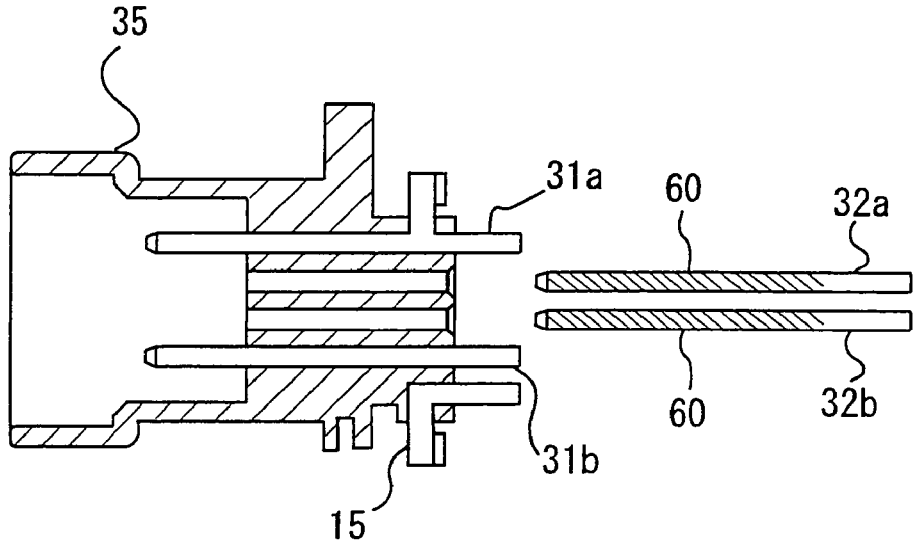
FIG. 7 is a view showing the state before external connection terminals are integrated into a connector housing of an internal combustion engine ignition device according to a third embodiment of the invention.
Figure 8:
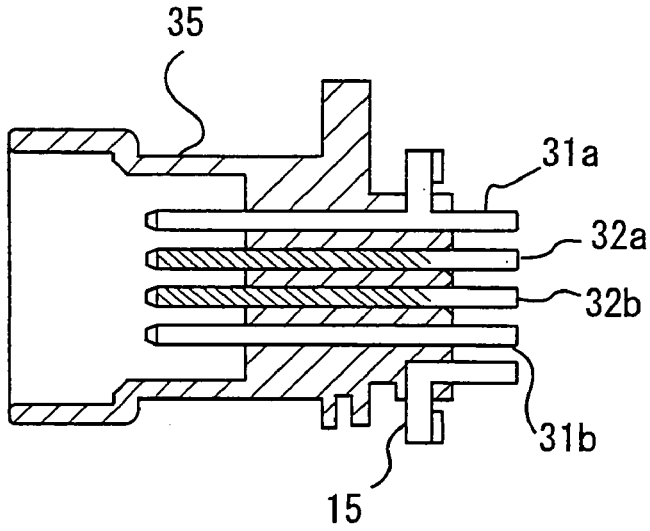
FIG. 8 is a view showing the state after the external connection terminals have been integrated into the connector housing of the internal combustion engine ignition device according to the third embodiment of the invention.
Figure 9:
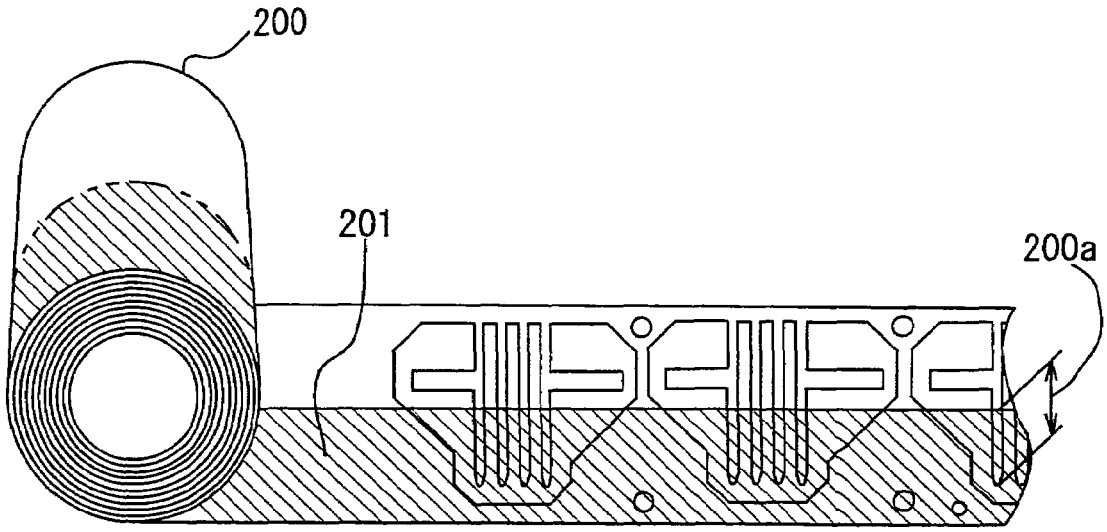
FIG. 9 PRIOR ART
FIG. 9 is a view showing material to be pressed for forming external connection terminals of a connector of the conventional internal combustion engine ignition device coil.

FIG. 7 is a view showing the state before external connection terminals are integrated into a connector housing of an internal combustion engine ignition device according to a third embodiment of the invention. FIG. 8 is a view showing the state after the external connection terminals are integrated into the connector housing of the internal combustion engine ignition device according to the third embodiment of the invention.

According to this third embodiment, as shown in FIGS. 7 and 8, the first external connection terminals 31*a* and 31*b* through which current of ampere order is carried have preliminarily been integrally molded with resin in the connector housing 35. Further, the first external connection terminals 31*a* and 31*b*, which are integrally molded with resin, are disposed on the outer side of terminal arrangement in the connector housing 35. Whereas, the second external connection terminals 32*a* and 32*b* onto which a noble metal coat 60 is applied are arranged for insertion into insertion holes provided in the connector housing 35.

Further, a connection terminal 15 providing the connection between the transformer 10 and the control circuit section 20 is molded integrally with the connector housing 35 in which the first external connection terminals 31*a* and 31*b* are integrally molded with resin. The other construction is the same as in the foregoing first embodiment.

As described above, according to this third embodiment, the first external connection terminals 31*a* and 31*b* are integrally molded with resin in the connector housing 35; as well as the second external connection terminals 32*a* and 32*b* onto which the noble metal coat 60 is applied are inserted in the insertion holes formed in the connector housing 35. Accordingly, the possibility of incorrectly integrating the first external connection terminals 31*a* and 31*b* and the second external connection terminals 32*a* and 32*b* will be eliminated. Further, the first external connection terminals 31*a* and 31*b* are disposed on the outer side of terminal arrangement in the connector housing 35, so that no short circuit fault between the external connection terminals through which a large current is carried will occur.

Furthermore, the connection terminal 15 providing the connection between the transformer 10 and the control circuit section 20 is molded integrally with the connector housing 35, so that the assembly procedure of the device will be simplified.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. An internal combustion engine ignition device comprising:

a transformer that generates a high voltage at a secondary coil by carrying or interrupting a primary current flowing through a primary coil;

a control circuit section that controls said primary current in response to a control signal from outside; and a connector including a first external connection terminal carrying a current for said transformer, and a second external connection terminal carrying a current for said control circuit section;

wherein out of said first external connection terminal and said second external connection terminal, only said second external connection terminal is provided with a noble metal coat.

2. The internal combustion engine ignition device according to claim 1, wherein said first external connection terminal is disposed on the outer side of terminal arrangement in said connector; and said second external connection terminal is disposed on the center side of terminal arrangement in said connector.

3. The internal combustion engine ignition device according to claim 1, wherein insertion holes through which said first external connection terminal and said second external connection terminal are inserted are provided in a housing of said connector; and said insertion hole of said first external connection terminal and said insertion hole of said second external connection terminal are differently shaped.

4. The internal combustion engine ignition device according to claim 1, wherein said second external connection terminals form an integral whole with a molded resin.

5. The internal combustion engine according to claim 1, wherein said first external connection terminals are molded using resin integrally with the housing of said connector; and said second external connection terminals are inserted into insertion holes provided in the housing of said connector.

6. The internal combustion engine according to claim 5, wherein a connection terminal providing the connection between said transformer and said control circuit section is molded using resin integrally with the housing of said connector.

* * * * *